US005706912A

United States Patent [19]

Holland

[11] Patent Number: 5,706,912

[45] Date of Patent: Jan. 13, 1998

[54] CHECKSTAND COUNTER WITH DUAL ACCUMULATION ZONES

[75] Inventor: A. Ronald Holland, Jacksonville, Fla.

[73] Assignee: Load King Manufacturing Co., Inc., Jacksonville, Fla.

[21] Appl. No.: 515,255

[22] Filed: Aug. 15, 1995

[51] Int. Cl.[6] ..... A63F 9/02

[52] U.S. Cl. ..... 186/68; 186/69

[58] Field of Search ..... 186/59, 60, 68, 186/69

[56] References Cited

U.S. PATENT DOCUMENTS

| | | | |
|---|---|---|---|
| 2,569,711 | 10/1951 | Foster | 186/68 X |
| 3,076,528 | 2/1963 | Potrafke | 186/68 |
| 3,561,566 | 2/1971 | Portrafke | 186/68 |
| 3,688,873 | 9/1972 | Potrafke | 186/59 X |
| 4,386,679 | 6/1983 | Mary | 186/68 |
| 4,392,553 | 7/1983 | Foster | 186/68 X |
| 5,390,764 | 2/1995 | Kerber | 186/68 |

*Primary Examiner*—D. Glenn Dayoan
*Attorney, Agent, or Firm*—Thomas C. Saitta

[57] ABSTRACT

A checkout stand or counter for accumulating a number of discrete items having a primary conveyor to deliver items to a primary accumulation zone at the far end and exterior side of the upper surface, a secondary conveyor to deliver items to a secondary accumulation zone adjacent the cashier recess, and a diverter to shunt items placed on the interior portion of the primary conveyor onto the secondary conveyor, while allowing items placed on the exterior portion of the primary conveyor to be directed to the primary accumulation zone. The diverter can be fixed, pivotable or extendable.

13 Claims, 2 Drawing Sheets

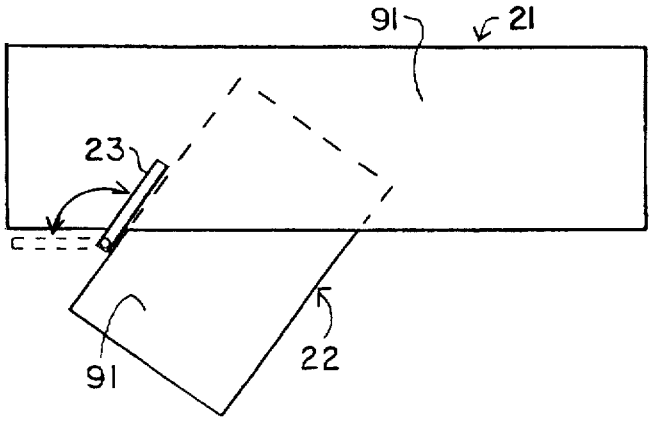
FIG 4
FIG 5
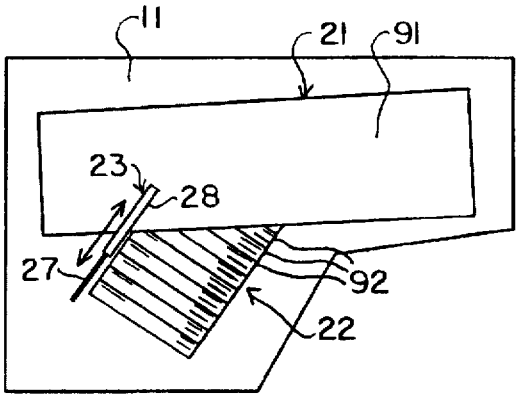
FIG 6
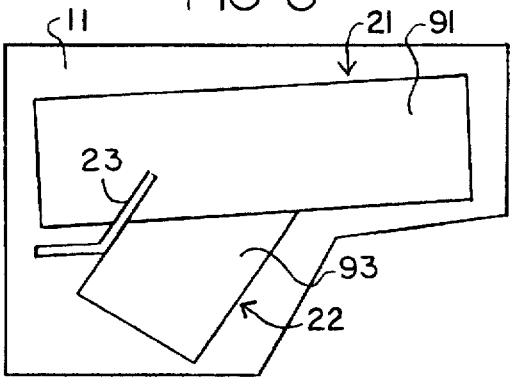
FIG 7
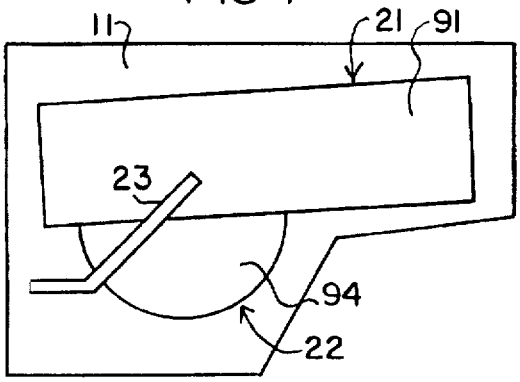
FIG 8
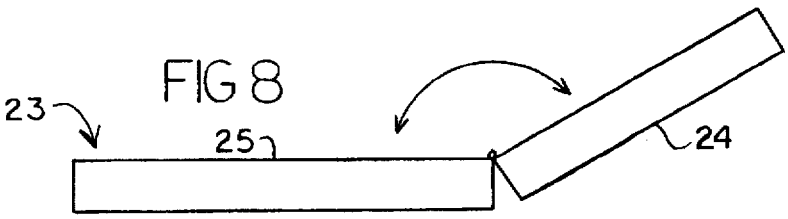

CHECKSTAND COUNTER WITH DUAL ACCUMULATION ZONES

BACKGROUND OF THE INVENTION

This invention relates generally to checkstand counters having conveyor means for moving numerous items from one position to another position, of the type most commonly to be found in grocery stores or supermarkets where a checkout cashier prices individual items and uses the conveyor means to transport them to an accumulation station or zone for bagging. More particularly, the invention relates to checkstand counters having dual conveyor means which transport the items to separate accumulation or bagging zones. Even more particularly, the invention is drawn to checkstand counters where one accumulation zone is located proximate to the checkout cashier and the other accumulation zone is distant from the cashier, and where items can be selectively diverted to either accumulation zone.

Automatic conveying checkout or checkstand counters are well known in grocery stores and supermarkets, comprising an unloading zone for placement of the individual items from a cart onto the counter, a pricing zone and a bagging or accumulation zone. The unloading zone may be a stationary countertop or may be a moving conveyor belt or turntable which brings the items within reach of the cashier stationed in the interior operator area of the stand. The cashier then inputs into a price tallying system the cost of the items either manually or by scanning devices, and then places, slides or transports the items to an accumulation or bagging area of the counter. The bagging area may be a continuation of the unloading area or may be a separate counter. A most simple configuration is a single belt conveyor taking the items from the unloading area, past the cashier and to the accumulation area. A more modern configuration has a first belt or turntable forming the unloading area and ending at a transition or pricing area adjacent the cashier, coupled with a second belt or a turntable taking the items to the accumulation area. The first belt brings the items to the cashier for pricing, and after pricing the cashier places the items on the second belt or turntable for transport to the accumulation area where a second individual bags the items for the customer. In many instances, the second belt or turntable is replaced by a sloped, low-friction surface or a number of parallel rollers.

A problem with conventional checkstands is that, since the accumulation area must be large enough to accommodate a high number of items, the far end of the accumulation or bagging zone is usually a good distance from the cashier. When a second worker is not available to bag the items and the cashier must price and bag the items, the cashier must awkwardly stretch to the end of the accumulation area to retrieve the items for bagging. This is inefficient and often leads to back, shoulder or arm injuries. A second problem with conventional checkstands is that there is no way to separate crushable or breakable items from the remainder of the items sent to the accumulation area. This requires the cashier to manually segregate these goods during the pricing operation, which slows the process. Still another problem with conventional systems is that there is no way to separate the items of one customer from the next, so that the cashier must wait until the bagger has finished before sending the items from the next customer into the accumulation area.

It is an object of this invention to provide a checkstand assembly which solves the above problems by providing means to divert items into one of two accumulation zones, such that fragile goods can be separated from durable goods, and such that the items of one customer can be maintained separate from the items of the previous customer. Further, it is another object to provide a checkstand assembly where one of the two accumulation zones is proximate to both the cashier and the bagger, such that either person can easily retrieve the items in that accumulation zone for bagging. It is a still further object to provide such a checkstand in various embodiments, including the use of a single moving transporter means coupled with a stationary sliding surface, dual moving transporter means comprising combinations of belts, turntables or parallel rollers, fixed diverter means or positionable diverter means, while still accomplishing the objects of the invention by providing for dual accumulation zones, one of which is easily accessible to the cashier and to a bagger at the far end.

SUMMARY OF THE INVENTION

The invention is a checkout or checkstand counter with two accumulation or bagging zones, one of which is a primary zone and is located at the distal or far end of the counter, the other of which is a lateral or secondary zone that is located adjacent the cashier position so as to be accessible from both the cashier position and the far end. The checkstand counter comprises in general a base member for supporting the upper surfaces, a forward end which can incorporate the unloading zone if the entire checkstand is a unitary device or which is adapted to correspond to the rear or pricing area end of a separate unloading counter, a cashier recess to provide a space for the cashier to work, a primary conveyor means to transport the items from the forward end to the primary accumulation zone at the far end, a secondary conveyor means extending laterally at an angle from the primary conveyor means to transport the items to the secondary accumulation zone, a product diverter means either fixed or positionable relative to the primary conveyor means to divert the items onto the secondary conveyor means, and a wide main platform portion forming the two accumulation zones to receive items conveyed by either the primary or secondary conveyor means, the wide platform being bounded by a far or distal end, a short side, a long side adjacent the customer lane and a side of the cashier recess. Mounted onto the checkstand counter in typical manner are side and end rails to retain the items on the top of the counter, and the checkstand can further comprise other standard features well known in the industry such as check writing pads, bar code scanner windows, a cash register platform, bag receptacles or the like.

The conveyor means can comprise endless belt conveyors powered by one or more motors, rotating turntables, parallel rollers or sloping low-friction surfaces, all of which are well known in the industry. Powered conveyor belts are the preferred embodiment for both the primary and secondary conveyor means, and especially for the primary conveyor means. The primary conveyor means extends from the forward end to the distal end, generally parallel to the long customer side of the platform, and is adapted to move items from the forward end to the distal end where they accumulate in the primary accumulation zone along the rear rail for bagging by a person other than the cashier. The secondary conveyor means abuts and extends at an angle to the side of the primary conveyor means and moves items shunted from the primary conveyor means into the lateral or secondary accumulation zone along the short side of the platform portion. The secondary accumulation zone is easily reachable from both the cashier recess and from the distal end of the counter. The shunting of items from the primary to the secondary conveyor means is accomplished by a diverter means which can be a fixed member positioned at an angle generally parallel to the line of travel of the secondary conveyor means. The diverter means extends over a portion, for example preferably about one-third to two-thirds, of the support surface of the primary conveyor means on the interior side, the side nearest the cashier recess. Additionally, the diverter means can be sliding or pivoting member which can be moved to extend either partially or completely over the primary conveyor means to shunt some or all of the items onto the secondary conveyor means, or which can be fully retracted into a non-active position whereby all the items remain on the primary conveyor means. When the diverter means is positioned to block an interior portion of the support surface of the primary conveyor means, the particular position of the items placed on the primary conveyor belt determines to which accumulation zone each item will be sent. Placement of an item on the exterior portion of the support surface, the side farthest from the cashier recess, results in the item being transported to the primary accumulation zone at the distal end of the counter. Placement of the item on the interior portion of the support surface of the primary conveyor, the side nearest the cashier recess, results in the item being blocked by the diverter means and shunted onto the secondary conveyor means where it is transported to the secondary accumulation zone. In this manner, the cashier can separate fragile items from durable items, can separate the goods of one customer from the goods of the preceding customer, or can position all the items within easy reach in the secondary accumulation zone when the cashier will be performing the bagging operation.

BRIEF DESCRIPTION OF THE DRAWINGS

FIG. 4 is a top view showing the relative positioning of the two conveyor means.

FIG. 5 is a top view of an alternative embodiment of the invention showing a retractable diverter means and parallel rollers as the secondary conveyor means.

FIG. 6 is a top view of another alternative embodiment showing a low-friction sliding surface as the secondary conveyor means.

FIG. 7 is a top view of still another alternative embodiment of the invention, in which a rotating turntable is utilized for the secondary conveyor means.

FIG. 8 is a side view of a hinged embodiment of the product diverter.

DETAILED DESCRIPTION OF THE INVENTION

Figure 1:
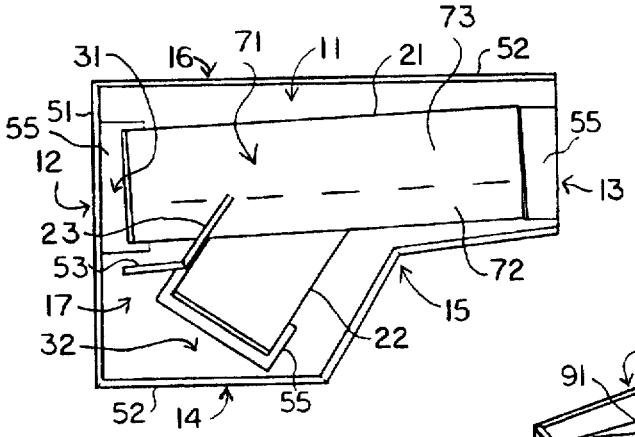
FIG. 1 is a top view of the invention.
Figure 2:
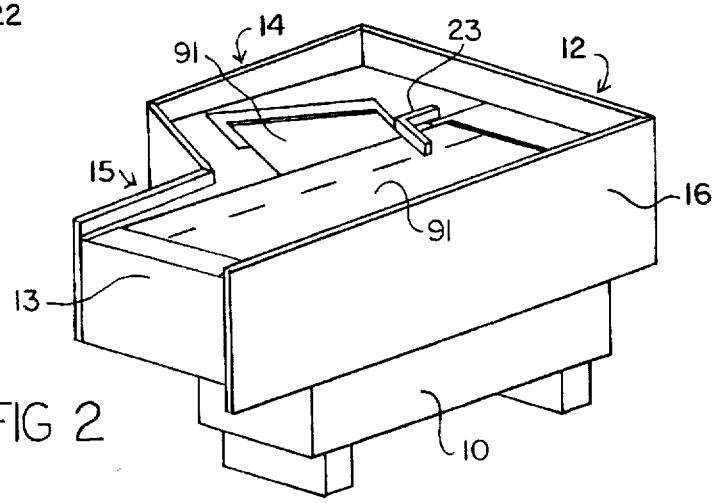
FIG. 2 is a perspective view of the invention as seen from the forward end.
Figure 3:
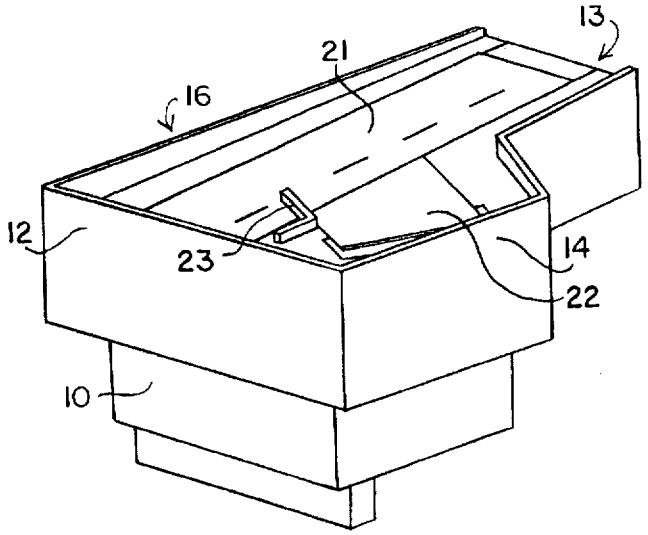
FIG. 3 is a perspective view of the invention as seen from the rear or distal end.

The invention will now be described with reference to the drawings and with regard to the best mode and preferred embodiment. As seen in FIGS. 1, 2 and 3, the invention is a checkstand or check-out counter, of a type adapted for use in grocery stores, supermarkets or any retail establishment where customers purchase large numbers of disparate goods which require individual pricing by a cashier and bagging for transport from the store, comprising in general a large, stable base member 10 with an upper surface 11 having a distal or far end 12, a wide platform portion 17, a forward or near end 13, a short or interior side 14, a cashier recess 15 and a long or exterior side 16. Located on the upper surface 11, which preferably slopes from the forward end 13 to the distal end 12, are a primary conveyor means 21 and a secondary conveyor means 22, a primary accumulation zone 31 and a secondary or lateral accumulation zone 32, and a product diverter means 23. The upper surface 11 is bounded by an end rail 51 and side rails 52 to prevent the items from falling off, with the forward end 13 preferably having no rail to impede placement of the items onto the primary conveyor means 21. The base member 10 is constructed in any known manner which provides sufficient support to the upper surface 11, and may further comprise additional elements found in typical checkstands such as drawers or receptacles for bags and other items, check writing pads, accent panels or other decorative elements, etc.

As shown best in FIG. 1, the provision of a cashier recess 15 adjacent the forward end 13 results in the upper surface 11 being relatively narrow at the forward end 13 and wide across the far end 12, forming a wide platform portion 17 capable of receiving and retaining a large number of items. The wide platform 17 comprises a primary accumulation zone 31 on the exterior side of the upper surface 11 and a secondary accumulation zone 32 on the interior side of the upper surface 11. Items are transported by primary conveyor means 21 to primary accumulation zone 31, or by secondary conveyor means 22 to secondary accumulation zone 32, where the items accumulate against the end rail 51 and side rails 52 to be placed into large bags by bagger personnel for removal by the purchasing customer. The primary accumulation zone 31 and the secondary accumulation zone 32 may be physically segregated by a dividing structure such as a wall or interior rail 53, which may be a part of the product diverter means 23, or the two accumulation zones 31 and 32 may be artificially separated as a result of the amount and direction of displacement between the primary conveyor means 21 and the secondary conveyor means 22.

The forward or narrow end 13 of the checkstand is adapted to correspond or mate with the rear or pricing zone of an unloading counter, such that the cashier standing in the cashier recess can price the individual items and then place them directly onto the primary conveyor means 21. Typically a low-friction transfer plate 55 abuts the forward end of the primary conveyor means 21 to allow products to be slid onto the primary conveyor means 21. Primary conveyor means 21 generally parallels the long customer side 16 of the checkstand and terminates near the end rail 51 in primary accumulation zone 31, often with another transfer plate 55 abutting the end of the primary conveyor means 21 so that items will easily slide into the primary accumulation zone 31 and not stack up on the primary conveyor means 21 when a large number of items are transported.

A secondary or lateral conveyor means 22 is positioned at an angle relative to the primary conveyor means 21 and extends toward the short or interior side 14 of the checkstand, such that items transported by secondary conveyor means 22 accumulate in the secondary accumulation zone 32 on the interior side of the wide platform 17. The line of travel of the secondary conveyor means 22 relative to the line of travel of the primary conveyor means 21 is preferably about 45 degrees, although angles up to 90 degrees are possible. A low-friction transfer plate 55 may again be provided at the end of the secondary conveyor means 22 to facilitate transfer of the items from the secondary conveyor means 22 into the secondary accumulation zone 32. The items transported by the secondary conveyor means 22 are retained by the side rail 52 and end rail 51. The secondary conveyor means 22 is positioned beneath or adjacent the primary conveyor means 21 so as to not interfere with the operation of the primary conveyor means 21, as shown in FIG. 4.

A product diverter means 23 is positioned a short distance above the support surface 71 of the primary conveyor means 21, which in effect divides the support surface 71 into an interior portion 72 adjacent the cashier recess 15 and an exterior portion 73 adjacent the long customer side 16. The diverter means 23 is placed at an angle relative to the direction of travel of the primary conveyor means 21 and preferably parallel to the line of travel of the secondary conveyor means 22, such that any items striking the diverter means 23 will be shunted from the primary conveyor means 21 onto the secondary conveyor means 22. The diverter means 23 interferes with only a portion of the primary conveyor means 21 support surface 71, extending onto the interior portion 72 about one quarter up to about two thirds of the full lateral distance of the primary conveyor means 21, and preferably extending about one third of the full lateral distance. In this preferred construction, the diverter means 23 divides the support surface 71 of the primary conveyor into an exterior portion 73 occupying about two thirds of the lateral distance and an interior portion 72 occupying about one third of the lateral distance. Items placed by the cashier onto the exterior portion 73 will bypass the diverter means 23 and be transported by the primary conveyor means 21 to the primary accumulation zone 31, while items placed onto the interior portion 72 will strike the diverter means 23 and be transferred onto the secondary conveyor means 22, which will transport them to the secondary accumulation zone 32. The primary conveyor means 21 can be marked by a line, dashes or other indicia, or can even be made different colors, to visibly differentiate the exterior portion 73 from the interior portion 72 so that the cashier will correctly position the item on the primary conveyor means 21.

Because the secondary accumulation zone 32 occupies the area of the upper surface 11 adjacent to the cashier recess 15, the short side 14 and the interior part of the far end 12, items in the secondary accumulation zone 32 are easily accessible from both the far end 12 of the checkstand and the cashier recess 15, such that the items in the secondary accumulation zone 32 can be reached by either a bagger or the cashier without undue stretching. Items accumulated in the primary accumulation zone 21 are easily accessible only to the bagger at the far end 12 of the checkstand.

The preferred embodiment for the primary conveyor means 21 is a powered endless conveyor belt 91 of the type commonly used in the industry, which consists of an endless belt encircling a drive roller and an opposing free turning roller. The belt 91 is positioned such that the support surface 71 transports items from the forward end 13 of the upper surface 11 to the far end 12. Other types of primary conveyor means 21 could be utilized, such as an inclined low-friction surface, typically constructed of stainless steel or a polymer material, or a plural roller surface composed of a number of rollers mounted adjacent and in parallel. These substitute systems are not preferred however, as both would require the items to be pushed toward the diverter means with enough force to deflect to the secondary accumulation area 32 and could result in damage to the items. A better alternative embodiment for the primary conveyor means is a rotating turntable 94 in place of the powered conveyor belt 91, since in either of these embodiments the force to transfer the item onto the secondary conveyor means 22 is provided by the primary conveyor means 21 itself, with the diverter means 23 simply moving the item laterally as it progresses toward the far end 12 until the item slides onto the secondary conveyor means 22.

The preferred embodiment for the secondary conveyor means 22 is also a powered endless conveyor belt 91 having a drive roller and a free turning roller, with a portion of the secondary conveyor means 22 being positioned beneath the primary conveyor means 21, as shown in FIG. 4. When an item is shunted from the primary conveyor means 21 onto the secondary conveyor means 22, it is transported into the secondary accumulation zone 32. Alternative embodiments for the secondary conveyor means 22 in the manner of plural aligned rollers 92 as shown in FIG. 5 or low-friction sliding surfaces 93 as shown in FIG. 6, while not preferred, are better suited for alternates of the secondary conveyor means 22 rather than as substitutes for the primary conveyor means 21 since the diversion of the items onto the secondary conveyor means 22 occurs on the primary conveyor means 21 and the secondary conveyor means 22 need only transport the items linearly into the secondary accumulation zone 32. Additionally, a rotating turntable 94 could also be used as the secondary conveyor means 22, as shown in FIG. 7.

Preferably the diverter means 23 is a fixed, rigid member such as a bar or rod with one end attached to the upper surface 11 of the checkstand and a free end extending over the support surface 71 of the primary conveyor means 21, as shown in FIG. 1. The diverter means 23 can be hinged such that the forward portion 24 extending over the primary conveyor means 21 can be vertically pivoted back onto its attached portion 25, as seen in FIG. 8, whereby no items are diverted onto the secondary conveyor means 22. Likewise, the fixed diverter means 23 can have an additional hinged extension member which can be positioned to block entirely primary conveyor means 21, thereby shunting all items onto secondary conveyor means 22. In alternative embodiments, the diverter means 23 can be pivotally attached to the upper surface 11 as shown in FIG. 4, such that it can be rotated completely off of primary conveyor means 21, or it can be retractable, as shown in FIG. 5, having a fixed portion 27 and a sliding member 28 which can be extended over primary conveyor means 21 either partially or fully, or can be fully retracted out of the way.

The invention allows the cashier to direct items into either the primary accumulation zone 31 or the secondary accumulation zone 32 without having to adjust or alter any component to correspond to any particular item. To separate fragile items from durable items, the cashier places all items of one group, for example the fragile items, onto the interior portion 72 of the primary conveyor means 21, with all the items of the other group, the durable items, placed onto the exterior portion 73, or vice-versa. Thus, in the first scenario, all fragile items will be shunted onto the secondary conveyor means 22 by the diverter means 23 and deposited in the secondary accumulation zone 32, while all durable items will remain on the primary conveyor means 21 and be deposited into the primary accumulation zone 31. Alternatively, the cashier can send all items of a first customer into the primary accumulation zone 31 by placing all items onto the exterior portion 73 of the primary conveyor means 21, and then send all items of a second customer into the secondary accumulation zone 32 by placing all the items onto the interior portion 72 of the primary conveyor means 21 to be diverted by the diverter means 23 onto the secondary conveyor means 22. Finally, when no additional personnel are available to bag the items, the cashier can place all items onto the interior portion 72 of the primary conveyor means 21 or, in certain embodiments, can position the diverter means 23 to completely block the primary conveyor means 21, such that all items are shunted onto the secondary conveyor means 22 and transported into the secondary accumulation zone 32, where all the items will be within easy reach to be efficiently and safely bagged by the cashier.

It is contemplated that equivalents and substitutions for certain elements and components may be apparent to those skilled in the art, and the true scope and definition of the invention therefore is to be as set forth in the following claims.

I claim:

1. A checkstand counter for accumulating a number of disparate items for subsequent placement into bags for transport, said checkstand counter comprising:

(A) a base member having a far end, a near end, a long exterior side, a short interior side, a cashier recess, an upper surface with an exterior side and an interior side, and a wide platform portion defined by said cashier recess, said short interior side, said far end and a portion of said long exterior side;

(B) a primary accumulation zone positioned on said exterior side of said upper surface in said wide platform portion, said primary accumulation zone being adjacent said far end;

(C) a secondary accumulation zone positioned on said interior side of said upper surface of said wide platform portion, said secondary accumulation zone being adjacent said cashier recess;

(D) primary conveyor means extending from said near end into said wide platform portion along said exterior side of said upper surface, said primary conveyor means adapted to transport items from said near end to said primary accumulation zone, said primary conveyor means having a support surface with an exterior portion and an interior portion;

(E) secondary conveyor means extending angularly from said primary conveyor means into said wide platform portion to said interior side of said upper surface, said secondary conveyor means adapted to transport items to said secondary accumulation zone; and (F) diverter means positioned to block said interior side of said support surface of said primary conveyor means, whereby items placed on said interior side of said support surface are diverted onto said secondary conveyor means.

2. The device of claim 1, where said primary conveyor means comprises a powered belt.

3. The device of claim 1, where said primary conveyor means comprises a sloped, low-friction surface.

4. The device of claim 1, where said primary conveyor means comprises a series of rollers.

5. The device of claim 1, where said primary conveyor means comprises a rotating turntable.

6. The device of claim 1, where said secondary conveyor means comprises a powered belt.

7. The device of claim 1, where said secondary conveyor means comprises a sloped, low-friction surface.

8. The device of claim 1, where said secondary conveyor means comprises a series of rollers.

9. The device of claim 1, where said secondary conveyor means comprises a rotating turntable.

10. The device of claim 1, where said diverter means is a fixed member attached to said upper surface with a free end extending over said interior portion of said support surface of said primary conveyor means.

11. The device of claim 1, where said diverter means is a pivoting member attached to said upper surface with a free end extending over said interior portion of said support surface of said primary conveyor means.

12. The device of claim 1, where said diverter means is an extendable member attached to said upper surface with a free end extending over said interior portion of said support surface of said primary conveyor means.

13. The device of claim 1, where said primary accumulation zone and said secondary accumulation zone are separated by a dividing rail.

* * * * *